US011053682B1

(12) United States Patent
Zhang

(10) Patent No.: US 11,053,682 B1
(45) Date of Patent: Jul. 6, 2021

(54) HIGH STRENGTH MAIN TEE SPLICE

(71) Applicant: USG Interiors, LLC, Chicago, IL (US)

(72) Inventor: Hui Zhang, Buffalo Grove, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 16/816,319

(22) Filed: Mar. 12, 2020

(51) Int. Cl.

| | |
|---|---|
| ***E04B 9/12*** | (2006.01) |
| ***E04B 9/06*** | (2006.01) |
| *E04B 9/10* | (2006.01) |
| *E04B 9/30* | (2006.01) |
| *E04C 3/04* | (2006.01) |

(52) U.S. Cl.
CPC ..... *E04B 9/122* (2013.01); *E04B 9/068* (2013.01); *E04B 9/10* (2013.01); *E04B 9/127* (2013.01); *E04B 9/30* (2013.01); *E04B 2009/062* (2013.01); *E04C 2003/046* (2013.01)

(58) Field of Classification Search
CPC . E04B 9/068; E04B 9/10; E04B 9/122; E04B 9/127; E04B 9/30; E04B 2009/062; E04B 2009/046
See application file for complete search history.

(56) References Cited

U.S. PATENT DOCUMENTS 2,689,630 A * 9/1954 Drury ..... E04B 9/122 52/506.07
2,946,414 A * 7/1960 Gordon ..... E04B 9/10 52/476
3,169,614 A * 2/1965 McCoy ..... E04B 9/127 52/506.06
3,221,466 A * 12/1965 Downing, Jr. ..... E04B 9/10 52/848
3,284,977 A * 11/1966 Lickliter ..... E04B 9/08 52/506.07
3,286,427 A * 11/1966 Cotter ..... E04B 9/10 52/506.07
3,288,489 A * 11/1966 Jahn ..... E04B 9/10 403/285
3,297,345 A * 1/1967 Downing, Jr. ..... E04B 9/10 403/326
3,350,125 A * 10/1967 Adams ..... E04B 9/068 403/28
3,374,596 A * 3/1968 O'Brien ..... E04B 9/127 52/664
3,496,690 A * 2/1970 Jahn ..... E04B 9/08 52/232
3,565,474 A * 2/1971 Stumbo ..... E04B 9/10 403/219
3,722,167 A * 3/1973 Rousey ..... E04B 9/10 52/506.07
3,778,947 A * 12/1973 Sauer ..... E04B 9/08 52/232
3,846,031 A * 11/1974 Adams ..... E04B 9/068 403/28
3,890,760 A * 6/1975 Jones ..... F16B 7/0413 403/360

(Continued)

*Primary Examiner* — James M Ference
(74) *Attorney, Agent, or Firm* — Pearne & Gordon LLP

(57) ABSTRACT

A connector for a main tee of a suspended ceiling grid that has improved tensile strength achieved by accurately proportioning an end tab and receiving depression so that full lateral abutment between these elements is obtained to assure full engagement between lock lance edges and mating stop edges.

4 Claims, 2 Drawing Sheets

(56) References Cited

U.S. PATENT DOCUMENTS 3,898,784 A * 8/1975 Sauer ..... F16B 7/22 403/327
3,921,365 A * 11/1975 Nute, Jr. ..... E04B 9/10 403/345
3,928,950 A * 12/1975 Beynon ..... E04B 9/10 52/506.07
3,979,874 A * 9/1976 Cubbier, Jr. ..... E04B 9/10 52/664
4,161,856 A * 7/1979 Brown ..... E04B 9/00 52/667
4,314,432 A * 2/1982 Rosenbaum ..... E04B 9/10 403/363
4,317,318 A * 3/1982 Sauer ..... E04B 9/122 52/506.06
4,317,641 A * 3/1982 Sauer ..... E04B 9/122 403/347
4,389,828 A * 6/1983 Cary ..... E04B 9/064 52/506.06
4,462,198 A * 7/1984 Sharp ..... E04B 9/122 52/506.07
4,499,697 A * 2/1985 LaLonde ..... E04B 9/122 52/506.07
4,525,973 A * 7/1985 Vukmanic ..... E04B 9/122 403/346
4,535,580 A * 8/1985 Shirey ..... E04B 9/10 52/506.06
4,549,383 A * 10/1985 Vukmanic ..... E04B 9/122 403/347
4,611,453 A * 9/1986 Worley ..... E04B 9/122 403/347
4,648,230 A * 3/1987 Mieyal ..... E04B 9/122 52/667
4,677,802 A * 7/1987 Vukmanic ..... E04B 9/122 52/506.07
4,785,603 A * 11/1988 Platt ..... E04B 9/122 52/506.07
4,989,387 A * 2/1991 Vukmanic ..... E04B 9/122 52/667
5,137,390 A * 8/1992 Felsen ..... E04B 9/10 403/347
5,271,202 A * 12/1993 Vukmanic ..... E04B 9/122 52/506.07
5,517,796 A * 5/1996 Koski ..... E04B 9/122 52/506.07
5,761,868 A * 6/1998 LaLonde ..... E04B 9/122 52/506.07
5,839,246 A * 11/1998 Ziegler ..... E04B 9/068 52/506.07
6,047,511 A * 4/2000 Lehane ..... E04B 9/10 52/506.07
6,138,425 A * 10/2000 Wendt ..... E04B 9/00 403/205
6,305,139 B1 * 10/2001 Sauer ..... E04B 9/10 403/346
6,729,100 B2 5/2004 Koski et al.
7,926,238 B2 * 4/2011 Sareyka ..... E04B 9/068 52/506.06
8,584,418 B2 * 11/2013 Underkofler ..... E04F 13/0803 52/506.05
8,782,985 B2 * 7/2014 Gulbrandsen ..... E04B 9/10 52/506.06
9,062,447 B2 * 6/2015 Lehane, Jr. ..... E04B 9/122
9,371,649 B2 * 6/2016 Cipriani ..... E04B 9/10
9,376,811 B2 * 6/2016 Cipriani ..... E04B 9/068
9,637,918 B1 * 5/2017 Carbajal ..... E04B 9/122
10,011,987 B1 * 7/2018 Lehane ..... E04B 9/10
10,302,115 B2 * 5/2019 Bickers ..... A47B 96/1458
2003/0200719 A1 * 10/2003 Koski ..... E04B 9/10 52/843
2006/0260246 A1 * 11/2006 LaLonde ..... E04B 9/10 52/506.07
2009/0293403 A1 * 12/2009 Cedrone ..... E04B 9/10 52/506.06

* cited by examiner

HIGH STRENGTH MAIN TEE SPLICE

BACKGROUND OF THE INVENTION

The invention relates to improvements in suspended ceiling grid components and, in particular, to end connectors for main runners or tees of such systems.

PRIOR ART

It is difficult to produce a main tee grid splice connector with previously known designs that is consistently easy to assemble in the field and that will result in a reliable and positive interconnection. Various known end connectors for main runners or tees can be somewhat difficult to install for numerous reasons. Such connectors may not be self-aligning and if they have provisions for self-alignment, their performance in this regard may be marginal at best. Smooth engagement and coupling between end connectors can be obstructed where the configuration of the connector parts have prominent surfaces or projections that interfere with the coupling advance of mating end connectors.

Typically, main runners are 12 feet long and are installed by a technician who, during an installation, grasps the runner, relative to the end being joined to a preceding runner, on the far side of its center. This permits proper balance and allows the technician to be in a suitable position to initially tie the runner up in suspended position. Thus, the technician is at least 6 feet away from the joint so that it is difficult for the technician to clearly see the end receiving pocket of the preceding runner. Moreover, from this location, the technician cannot cup the ends to be joined in one hand to align them together. Consequently, there remains in the art, a need for an end connection or splice system that affords self-aligning capability.

A more subtle but sometimes more troublesome problem occurs when the end connectors are out or nearly out of dimensional tolerance due to variations in material stock, tool wear or other manufacturing conditions. In this circumstance, the forces required to connect the ends of the runners may vary from one runner to the next so that the technician installing the grid is confounded by not knowing for sure if a good connection is being made. Additionally, these dimensionally marginal parts can require excessive assembly force, again to the distraction or frustration of the technician.

U.S. Pat. No. 6,729,100 discloses a main tee splice that has advanced the art and proven to be a consistently reliable product.

SUMMARY OF THE INVENTION

The invention departs from a previous practice of tightly vertically fitting an end tab or tongue of one splice to a receiving depression of a mating splice to achieve a remarkable increase in tensile force capacity. In accordance with the invention, the receiving depression along its base is deliberately made with a vertical average dimensional tolerance larger than a specified maximum height of the end tab. While vertical registration between splices may be insignificantly degraded, the splice joint can achieve a substantial increase in strength, reaching as much as 48% over prior art arrangements of equivalent material thickness. The disclosed splice joint can enable a reduction in the thickness of grid body material where, as preferred, the splice is integrally formed in the grid runner body. The result can be a significant savings in production cost.

In the illustrated embodiment, the end tab has elements for aligning itself to the receiving pocket of an opposed connector in both the vertical and horizontal directions. The vertical alignment feature is advantageously effective from a condition where the end tab misalignment is physically limited by the flange of the opposed tee runner. This structure enables a connection to be made where the end tab is first laid on the flange of the opposing previously installed runner and then is simply subjected to an endwise force by the installer. The leading profile of the end tab is effective, in the vertical location established by the flange of the opposed tee, to cam the end tab towards alignment with the mating connector. The vertical self-aligning character of the end tab is augmented by a lock lance element that registers with a groove in an opposed connector end tab. The vertical alignment action of the lock lance is assisted by horizontal alignment elements of the connector. The horizontal alignment elements of the connector comprise a lead angle formed by bending the forward portion of the end tab out of the plane of a main portion of the end tab and an outwardly flared entrance to the end tab receiving pocket. These lead angle and flared entrance elements provide relatively large, smooth caroming surfaces, as compared to edge areas, that improve the smooth functioning of the connector. The lead angle of the end tab and outward flare of the opposed connector are readily inter-engaged for horizontal alignment. Additionally, these lead angle and outward flare components avoid any direct edge-to-surface contact between these components so that smooth sliding action occurs when the lock lance moves out of the relief groove of the opposed connector in the late stages of the assembly movement where the potential interference between the connectors is greatest.

The disclosed connector is arranged to produce an audible click when a connection is completed and, therefore, signal the same to the installer technician. The repeatability and loudness of the click is the result of several structural elements of the connector. The lock lance has a locking edge configured to cause it to snap over a mating edge of the opposed connector without interference with the locking edge of the opposing connector. The resilient character of the receiving pocket of the opposed connector imparts kinetic energy to the end tab when its lock lance snaps over the locking edge of the opposed connector.

DESCRIPTION OF THE PREFERRED EMBODIMENT

Figure 3:
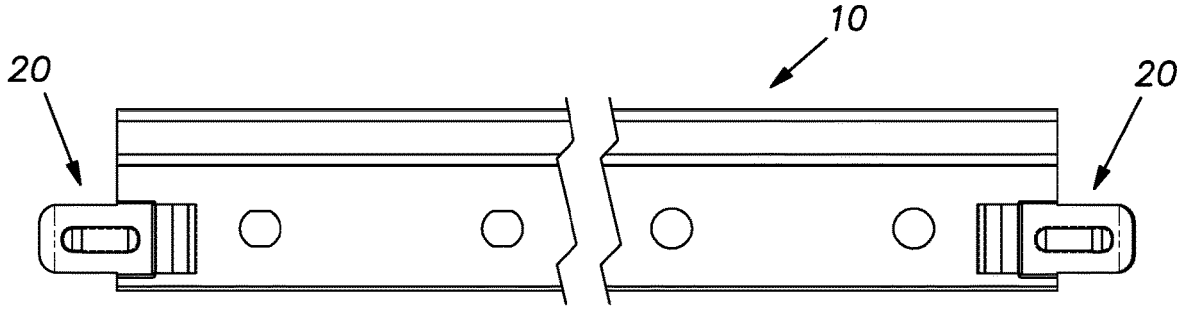
FIG. 3 is an elevational side view of a grid runner employing the invention.

Referring now to the drawings, and in particular to FIG. 3, there is shown a main runner or tee 10 of a general type commonly used for suspended ceiling grid systems as known in the art. Typically, such main runners or tees 10 are combined with cross runners or tees (not shown) to create a suspended grid work. In the illustrated example, the main tee 10 is made of two formed metal strips 12, 13 typically of steel, although other material such as aluminum can be used. One of the strips 12 forms an upper hollow bulb 14, a double wall web 16, and oppositely extending flanges 17 all integral with one another. The strip 12 can have, for example, a thickness of 0.008 inch to 0.024 inch depending on the application. The other strip 13 lies under the flanges 17 and is wrapped around the distal edges of the flanges 17 to lock the strip 12 in its tee shape, conceal the seam between the flanges 17 and provide a smooth appearance for a lower face 18 of the tee 10; the lower face 18 of the strip 13 typically is painted for appearance purposes. The lower strip 13 is a suitable material, typically steel, but can be other materials such as aluminum. Holes (not shown) through the web 16 enable the tee 10 to be suspended by wire or other means as is known in the art. It will be understood that the runner 10 can have various other shapes, besides a conventional tee shape as is known in the art.

The runner or tee 10 has an end connector or splice 20 that, in the illustrated case, is integral with the web 16. It will be understood that certain features of the invention can be applied to connectors that are formed in a single web wall or layer or are formed wholly or partially as separate elements that are joined to the main parts of a runner with rivets or other means as is known in the art. As is conventional, a runner or tee 10 will have a connector 20 at each end.

The connector 20 includes an end tab 21 and an end tab receiving pocket 22 that, as explained below, cooperate with an identical connector in the manner of a "handshake" to connect the opposed ends of two aligned tees or runners 10 together. The end tab 21 and pocket 22 are die cut and formed by suitable stamping dies. The end tab 21 projects from an imaginary vertical plane perpendicular to the lengthwise direction of the tee 10 and located where the lower face 18 terminates, this location being the nominal end of the tee proper. Major or "land" portions of the end tab 21 are planar and are offset from the plane of the center of the tee 10 (where the walls of the web 16 abut) by a distance at least equal to the thickness of the stock forming the walls of the web (i.e. the thickness of one web wall). As will be understood, this will allow a face of an end tab 21 to abut the face of another end tab substantially at the mid-plane of each of the tees 10 being joined or connected.

The side profile of the end tab 21 is generally rectangular having two parallel horizontal edges 23, 24 at the top and bottom, respectively. A plane of an end portion or lead angle 26 is at an acute angle of about 35°, for example, from the plane of the end tab proper to the side of the tee 10 from which the end tab is offset.

A lock lance 27 is stamped into a forward area of the end tab 21 at mid-height of the end tab. The lock lance 27 projects from the plane of the end tab proper to the same side to which the lead angle end portion 26 is bent and from which the end tab is offset. The lock lance 27 is bulbous and preferably has the general shape of a longitudinal half of a bullet. A locking edge 28 of the lance 27 is originally cut by a stamping die from a line common to an end edge 29 of a relief and alignment groove 31.

The relief groove 31 is vertically aligned with the lock lance 27 and extends longitudinally rearwardly from the lock lance to a somewhat rounded end 33 adjacent the receiving pocket 22. The relief groove 31 has a depth about equal or more than the height of the lock lance 27 and a width moderately larger than that of the lock lance.

Figure 5:
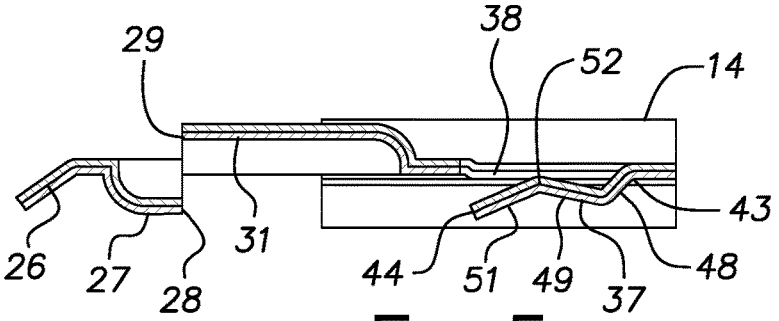
FIG. 5 is a cross-sectional view of the end splice taken in the plane 5-5 indicated in FIG. 4.
Figure 4:
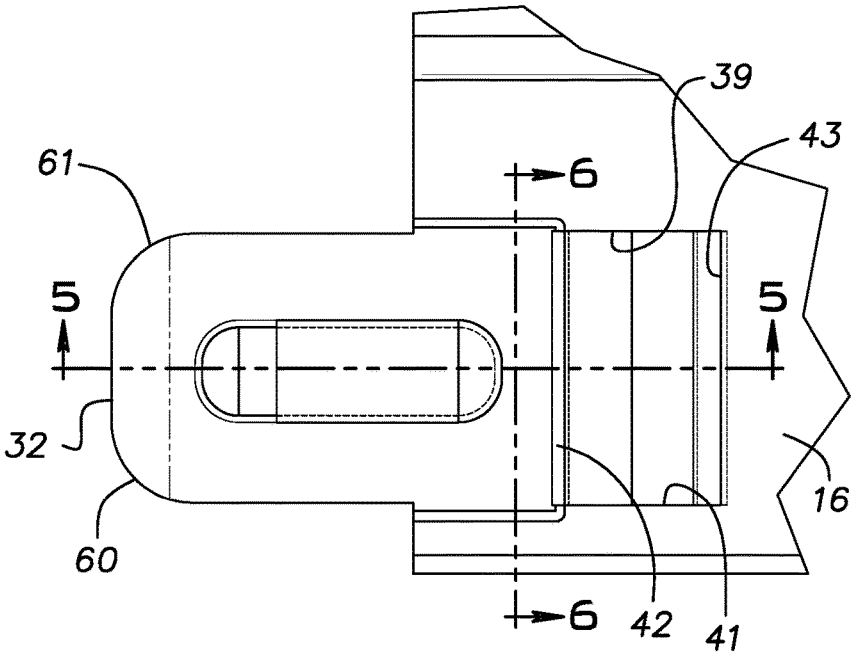
FIG. 4 is a side view, on an enlarged scale, of an end splice of a grid runner.

The tab receiving pocket 22 comprises a wall 37 and an opening 38. In the illustrated case, the wall 37 and opening 38 are rectangular and are produced by lancing or cutting the stock of the web 16 along parallel horizontal lines or cuts 39 and a vertical line or cut 42. Any burr at the cut or edge 42 should not be greater than 0.005 inch. The pocket wall 37 is integral with the web 16 along a side 43 proximal to the web 16 while the remainder including a distal edge 44 and top and bottom edges 46, 47 are cut free of the web. With particular reference to FIG. 5, the wall 37 is stamped into a non-planar configuration that, for the most part, is spaced laterally outward of the web 16. In this context, the plane of the web 16 is defined as the space occupied by the web proper. A region of the wall 37 proximal to the web 16 forms a hollow by virtue of a step portion 48 bent away from the plane of the web 16 and an intermediate portion 49 bent slightly back toward the plane of the web. The distal end of the pocket wall 37 is formed with an outwardly flared portion 51 at an angle to the plane of the web 16. The wall 37, when viewed in FIG. 5 is re-entrant at the zone of a bend line 52 between the outwardly flared portion 51 and intermediate portion 49 so that this zone 52 is exclusive in its proximity to the plane of the web 16 as compared to adjacent parts of the wall 37.

Figure 6:
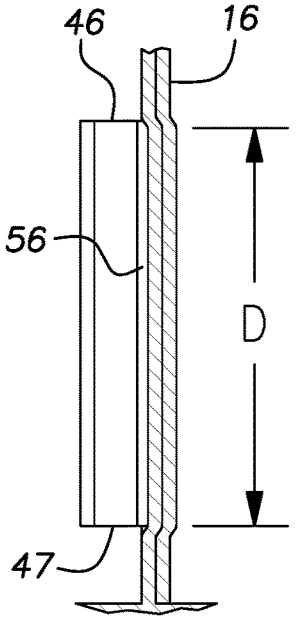
FIG. 6 is an enlarged cross-sectional view of an end tab receiving depression of the splice taken in the plane 6-6 indicated in FIG. 4.

The lateral or horizontal offset of the plane of the end tab 21 mentioned earlier provides a depression 56 at a rearward portion of the tab. Preferably, the depth or horizontal offset of the depression 56 equals a single thickness of a layer or ply of the two-ply web 16, that is, one-half the web thickness. In accordance with the invention, the depression 56 is accurately sized in the vertical direction to fully receive the projecting forward portion of the end tab 21 of an identical mating splice 20. By way of example, but not limitation, the vertical manufacturing dimension D (FIG. 6) at the base of the depression can be 0.636±0.005 inch while the maximum vertical height of the longitudinally projecting part of the end tab 21 can be 0.625±0.005 inch. Accordingly, there is effectively no dimensional interference between these production vertical heights of the end tab 21 and the depression 56. There is no longitudinal interference between these elements because the distal end of an end tab 21 is received in the opening 38. The opening 38 has a vertical dimension, for example, in production of 0.636±0.005 inch so there is a certain vertical clearance with the mating end tab 21. This dimensional configuration assures that the projecting part of one end tab 21 can fully laterally abut or contact the surface of the depression 56 of a mating splice 20. In turn, the full seating of flat portions of mating tabs 21 in respective depressions 56 assures that the lance projection 27 of each tab 21 engages an opposing edge or cut 42 of the respective opening 38 at the base of the lance projection locking edge 28 where it merges with its end tab proper and where it is stable and strongest. The lateral projection of the lock lance 27 beyond the web 16 is preferably at least equal to the full thickness of the web 16.

Figure 1:
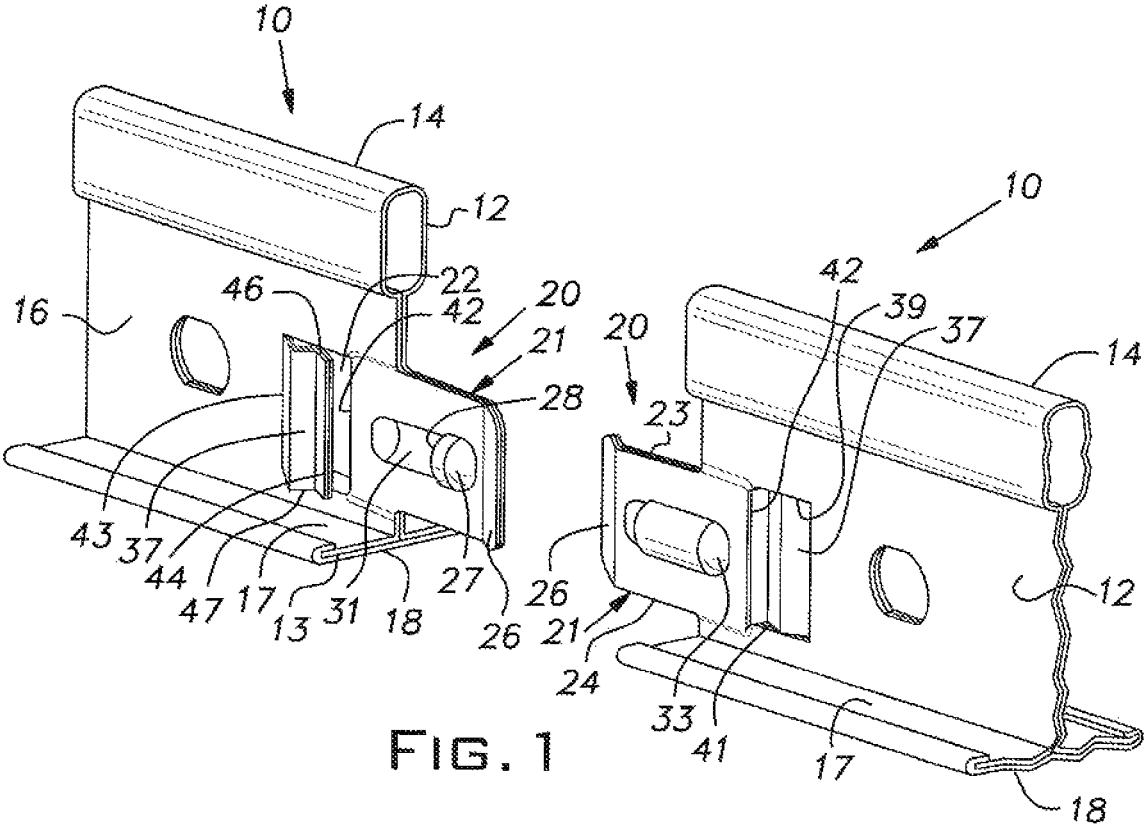
FIG. 1 is a perspective view of end portions of two main runners or tees shown prior to their endwise assembly or connection.
Figure 2:
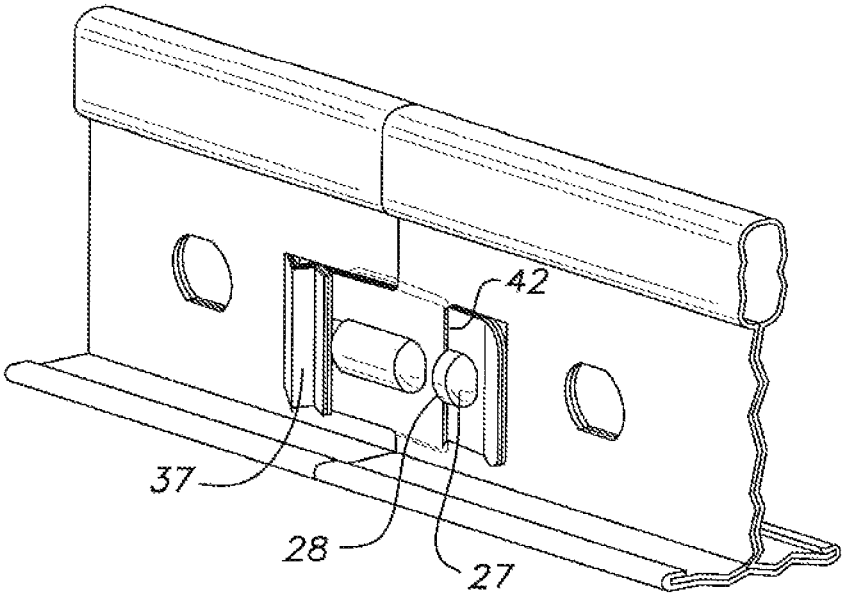
FIG. 2 is a view similar to FIG. 1 but with the end connectors or splices in full mutual engagement.

The connector 20 is adapted to mate with an identical connector as shown in FIG. 2. In this manner, successive main tees or runners 10 are joined together end-to-end to span a room or other space in which a suspended ceiling is to be constructed. An important feature of the connector 20 is its ability to self-align itself to a mating connector. The connector 20 of one tee 10 can rest on the upper side of a flange 17 of another tee. This condition most typically would be where one tee has previously been installed and another tee is being joined to the previously installed tee. A lower inclined, curved part 60 of the lead edge 32 has a portion which will be slightly higher than the lower edge of the pocket opening 38 of the opposed connector. Similarly, an upper inclined, curved part 61 of the lead edge of the relevant end tab has a portion which will be below the upper opening edge 39 of the connector 20. With the connector 20 urged horizontally or laterally towards the opposite connector, the lead angle end portion 26 slips into the pocket opening 38 of the opposed connector. Longitudinal force applied to the tee 10 being installed causes the inclined edge 60 working against the pocket opening edge 41 of the opposed connector to cam the connector 20 upwardly relative to the opposed connector and thereby self-aligns the connector to the opposed connector. Other shapes for the rounded edge parts 60, 61 capable of shifting the connector up or down when engaging the pocket structure are contemplated. This caroming action is augmented by two other caroming functions. Cam-like inter-engagement between the lead angle end portion 26 and the outwardly flared portion 51 of the pocket wall 37, at each set of these elements, biases the connectors 20 laterally or horizontally towards one another when the tees are forced axially or longitudinally towards one another. When the lock lances 27 inter-engage with the opposed relief grooves 31, these elements, in response to the lateral or horizontal bias developed by the sets of lead angle end portion 26 and pocket wall flare portion 51 cam the connectors 20 vertically, again in self-alignment action. The result of these combined caroming actions is that the connectors 20 are positively self-aligning and are comparatively easy to interconnect.

The relief groove 31 avoids significant interference between the connectors due to the projection of the lock lance 27 until after they have been effectively aligned by the end tabs 21 being substantially received in opposed pocket holes or openings 38. When the lock lances 27 reach the end 33 of the respective relief grooves 31 of their opposed connector 20 continued advance of the tee being installed requires the pocket walls 37 to momentarily resiliently deflect laterally outwardly to allow the lock lances to slide out of the ends of the grooves and over a short distance on the surface of the end tab proper until it passes the cut or edge 42 formed when the pocket wall 37 was made. The re-entrant character of the wall 37 allows the surface area of the bend line 52 to exclusively contact the opposing end tab 21 and assures consistent spring action. At this point, the lock lances 27, under the influence of the spring-like force developed by the deflected resilient pocket walls 37 snap longitudinally behind the edges 42 of the opposed connector thereby completing a connection or splice.

A beneficial result of the disclosed structural features of the connector is that an audible click is produced when the lock lance edges 28 pass over the edges 42 of the pocket openings 38 allowing the end tabs 21 to snap against one another. The click signals the installing technician that a connection has been completed. The loudness of this click is due in part to the geometry of the lock lance edge 28 which is, as discussed, 90 degrees or less, thereby avoiding a condition where if this edge were in a plane greater than 90 degrees, it would slide down the opposed locking edge 42 and mute the click.

The lead angle end portions 26 and the flared portions 51 of the pocket walls ensure that only surface-to-surface contact occurs when the greatest interference arises in the connection sequence as the lock lances slide over the land areas between the relief grooves 31 and the locking edges 42 of the openings 38. Contact between the front edge 32 of an end tab 21 or the distal edge 44 of the pocket wall 37 could greatly increase the frictional resistance between the connectors. In part, the re-entrant character of the wall at the bend line 52 avoids such edge contact. With the periphery of the pocket wall, specifically the edges 44, 46 and 47 (apart from where it is joined with the web proper), being free of connection with other parts of the connector, the pocket wall acts as a resilient spring. Consequently, the force to deflect it laterally for passage of the lock lance out of a groove 31 and over the adjacent land to the opening edge 42 is limited. In turn, the force to effectuate a connection is moderate and not prone to vary widely when the connectors 20 are nearly out of tolerance because of material thickness variation, tool wear or other manufacturing conditions. Such wide variation is known to occur in prior art connector designs and is found to be very objectionable to professional installation technicians.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A connector for a runner in a suspended ceiling comprising an end tab configured to extend longitudinally beyond the runner and an end tab receiving pocket, the end tab having a lead end and the receiving pocket being rearward of the end tab, the end tab having a body with planar body portions rearward of the lead end, material of the planar body portions defining a plane, the pocket being proportioned to receive a lead end of an identical connector, the pocket having a wall lying in a zone lateral of the plane of the body portions, the end tab having a locking projection projecting to a side of the end tab and having a rearwardly facing locking edge, the pocket having a depression and an open zone adjacent the depression for receiving an end tab, including a forward end, of the identical connector, the depression having a vertical height dimensioned to receive the end tab of the identical connector without interference in a vertical direction whereby when the end tab is received in the depression, the end tab fully abuts the depression, the open zone including a rearwardly facing edge to interlock with a locking edge of a projection of the identical connector, the depression being forward of the rearwardly facing edge.

2. The connector as set forth in claim 1, wherein the open zone has a vertical dimension larger than a maximum vertical dimension of the end tab.

3. The connector as set forth in claim 1, wherein the end tab includes a relief area for receiving a locking projection of said identical connector in assembly motion prior to full locking engagement with the identical connector.

4. A connector for a runner in a suspended ceiling comprising an end tab and an end tab receiving pocket with a laterally offset wall and with a depression, the end tab being arranged to project longitudinally beyond the runner and having a lead end with an edge, the receiving pocket being rearward of the end tab, the end tab having a body with planar portions rearward of the lead end, material of the planar body portions defining a plane, the pocket depression being proportioned to receive a lead end of an identical connector with no vertical clearance, a periphery of the wall being free of attachment from surrounding parts of the connector along a portion of a length of the wall in a direction of the end tab whereby the wall operates as a resilient spring, the end tab including a laterally projecting lock with a rearwardly facing locking edge, the pocket having an open zone for receiving a projecting lock of the identical connector with positive vertical clearance and including a rearwardly facing edge to interlock with a locking edge of the projecting lock of the identical connector, the depression being forward of the rearwardly facing edge, the wall being arranged to deflect as a spring a distance sufficient to enable the projecting lock of the identical connector to slide over areas of the end tab adjacent the rearwardly facing edge without resistance and maintain an end tab of the identical connector in full contact with the depression and areas of the locking edge of the projecting lock of the identical connector engaged with the rearwardly facing edge.

* * * * *